US009415924B1

(12) United States Patent
Drumheller

(10) Patent No.: US 9,415,924 B1
(45) Date of Patent: Aug. 16, 2016

(54) HAIR COLORING SYSTEM

(71) Applicant: Susanne M. Drumheller, Tampa, FL (US)

(72) Inventor: Susanne M. Drumheller, Tampa, FL (US)

( * ) Notice: Subject to any disclaimer, the term of this patent is extended or adjusted under 35 U.S.C. 154(b) by 0 days.

(21) Appl. No.: 14/492,047

(22) Filed: Sep. 21, 2014

(51) Int. Cl.

| | |
|---|---|
| ***B65D 81/32*** | (2006.01) |
| ***A45D 19/02*** | (2006.01) |
| ***A46B 11/00*** | (2006.01) |
| *A45D 19/00* | (2006.01) |

(52) U.S. Cl.
CPC ..... *B65D 81/3211* (2013.01); *A45D 19/02* (2013.01); *A46B 11/0072* (2013.01); *A45D 2019/0066* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,937,864 | A * | 8/1999 | Diaz | 132/112 |
| 8,146,606 | B2 * | 4/2012 | Schatteman et al. | 132/208 |
| 8,201,385 | B2 * | 6/2012 | McLean | 53/411 |

* cited by examiner

*Primary Examiner* — David Walczak

(57) ABSTRACT

A container has a side wall, a top, and a bottom. A fracturable membrane between the top and the bottom divides the container into an upper chamber and a lower chamber. A peroxide liquid fills the upper chamber. A colorant liquid fills the lower chamber.

1 Claim, 2 Drawing Sheets

HAIR COLORING SYSTEM

BACKGROUND OF THE INVENTION

Field of the Invention

The present invention relates to a hair coloring system and more particularly pertains to storing hair coloring components, for intermixing the hair coloring components, and for applying the intermixed hair coloring components to hair, Such applying is particularly useful for touch-up coloring between regular trips to the beauty parlor, The storing and intermixing and applying being done in a safe, convenient, and economical manner.

SUMMARY OF THE INVENTION

In view of the foregoing disadvantages inherent in the known types of hair coloring systems of known designs and configurations now present in the prior art, the present invention provides an improved hair coloring system. As such, the general purpose of the present invention, which will be described subsequently in greater detail, is to provide a new and improved hair coloring system and method which has all the advantages of the prior art and none of the disadvantages.

To attain this, in its broadest context, the present invention essentially comprises a container. The container has a side wall. The container has a top and a bottom. The container includes a fracturable membrane between the top and the bottom dividing the container into an upper chamber and a lower chamber. A peroxide liquid fills the upper chamber. A colorant liquid fills the lower chamber.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hair coloring system which has all of the advantages of the prior art hair coloring systems of known designs and configurations and none of the disadvantages.

It is another object of the present invention to provide a new and improved hair coloring system which may be easily and efficiently manufactured and marketed.

It is a further object of the present invention to provide a new and improved hair coloring system which is of durable and reliable constructions.

An even further object of the present invention is to provide a new and improved hair coloring system which is susceptible of a low cost of manufacture with regard to both materials and labor, and which accordingly is then susceptible of low prices of sale to the consuming public, thereby making such hair coloring system economically available to the buying public.

Lastly, another object of the present invention is to provide a hair coloring system for storing hair coloring components, for intermixing the hair coloring components, and for applying the intermixed hair coloring components to hair, Such applying is particularly useful for touch-up coloring between regular trips to the beauty parlor, The storing and intermixing and applying being done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
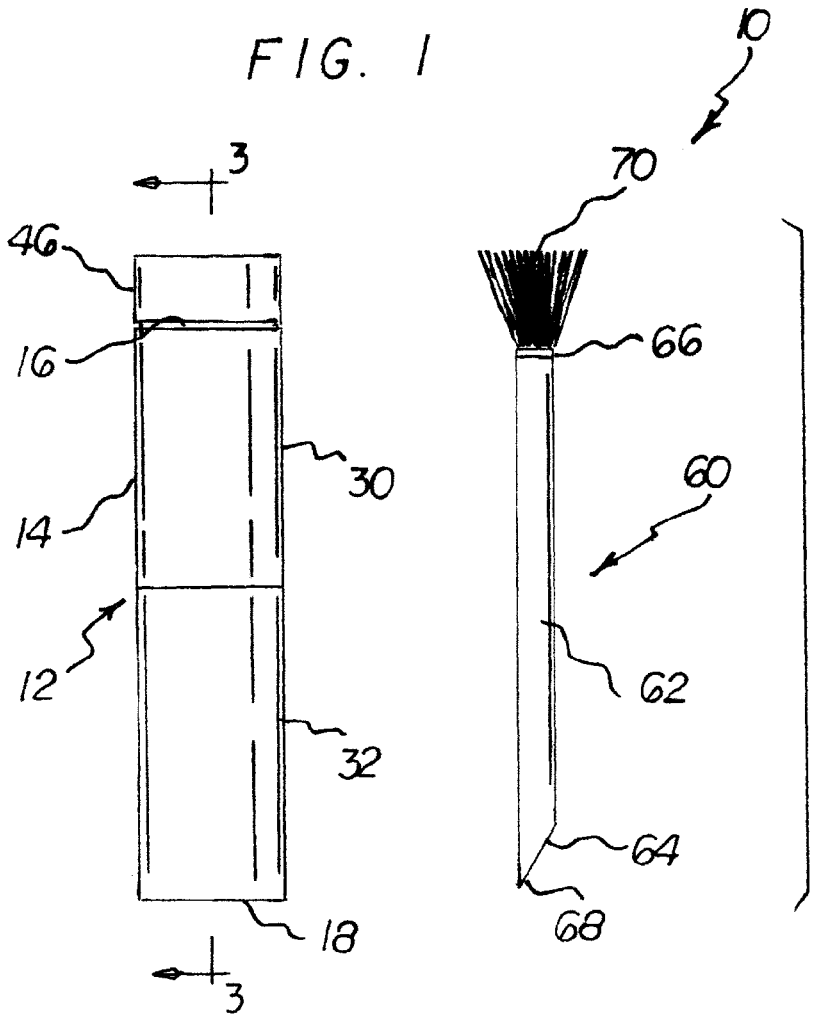
FIG. 1 is a front elevational view of a hair coloring system constructed in accordance with the principles of the present invention.
Figure 2:
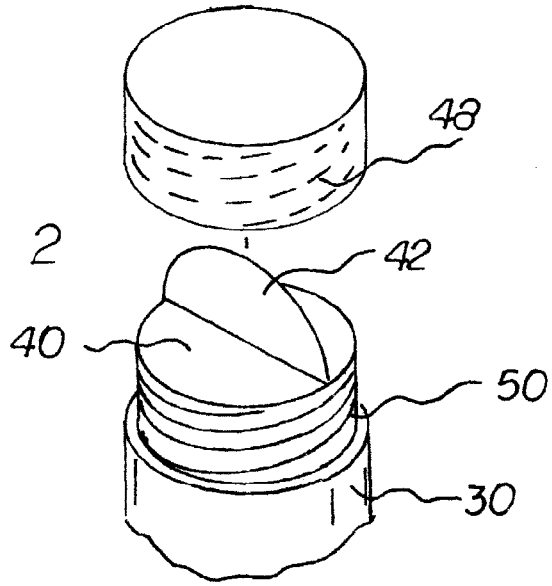
FIG. 2 is an exploded perspective illustration of the top of the container shown in FIG. 1.
Figure 3:
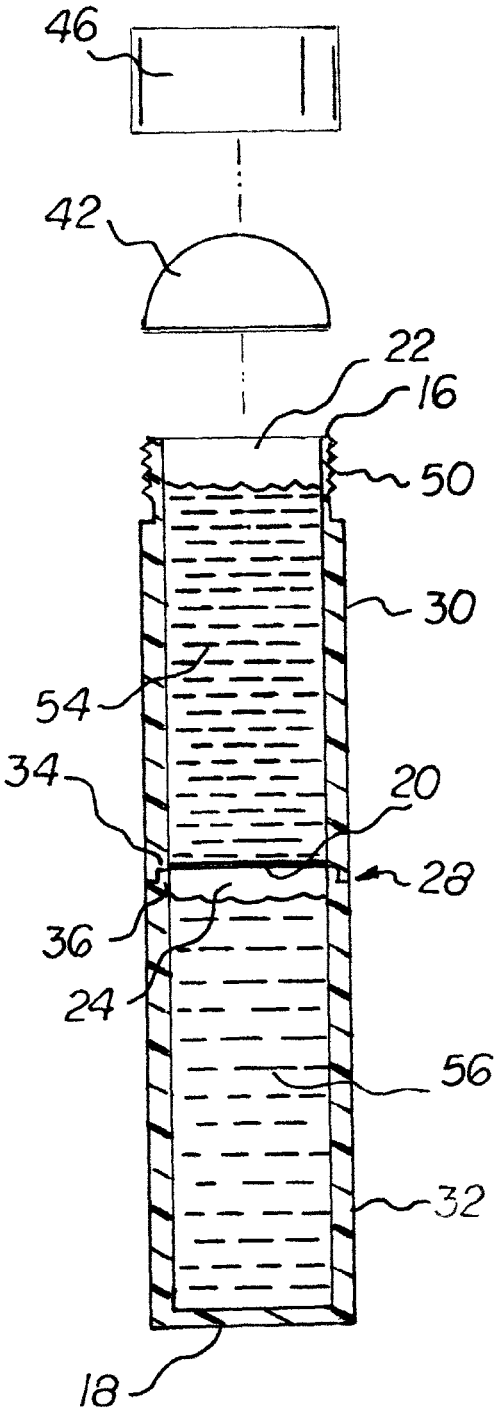
FIG. 3 is an exploded cross sectional view taken along line 3-3 of FIG. 1.
Figure 4:
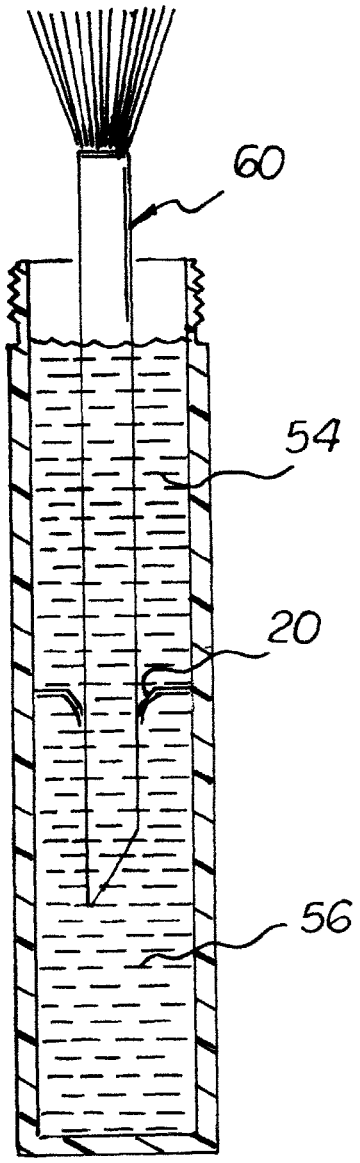
FIG. 4 is a cross sectional view similar to FIG. 3 but showing the tool rupturing the membrane.

With reference now to the drawings, and in particular to FIG. 1 thereof, the preferred embodiment of the new and improved hair coloring system embodying the principles and concepts of the present invention and generally designated by the reference numeral 10 will be described.

The present invention, the hair coloring system 10 is comprised of a plurality of components. Such components in their broadest context include a container and peroxide liquid. Such components are individually configured and correlated with respect to each other so as to attain the desired objective.

From a specific standpoint, first provided is a container 12. The container has a side wall 14. The side wall is in a cylindrical configuration. The container has a circular top 16. The container has a parallel circular bottom 18. The container includes a membrane 20. The membrane is also in a circular configuration. The membrane is located between and parallel with the top and the bottom. The membrane divides the container into an upper chamber 22 and a lower chamber 24. The upper chamber is located between the membrane and the top. The lower chamber is located between the membrane and the bottom. The membrane is located midway between the top and the bottom. In this manner the upper chamber and the lower chamber are rendered of a common volume. The membrane is fabricated of a fracturable material. The fracturable material is chosen from the class consisting of aluminum foil and tin foil. The container has a diameter. The container also has a length. The length is between 4 and 6 times the diameter.

A junction 28 is provided next. The junction is formed in the container. The junction is positioned at an intermediate location. In this manner the container is divided into an upper region 30 with the upper chamber and a lower region 32 with the lower chamber. The upper region has a radial interior annular recess 34. The radial interior annular recess is positioned at the junction. The lower region has a radial exterior annular recess 36. The radial exterior annular recess is positioned at the junction. The radial interior annular recess and the radial exterior annular recess are press fit together. The membrane is positioned between the radial interior and radial exterior annular recesses.

Provided next is a cover 40. The cover has a circular configuration. The cover is fabricated of a flexible plastic material. An adhesive is provided. The adhesive couples the cover to the top of the container. A semi-circular tab 42 is provided. The semi-circular tab extends upwardly from the cover. In this manner the cover may be removed from the container prior to use.

Also provided is a lid 46. The lid has interior female threads 48. The container has exterior male threads 50. The interior female threads are co-operable with the exterior male threads on the container adjacent to the top. The exterior male threads of the container removably receive and support the interior female threads of the lid. The container and the lid are fabricated of a rigid plastic material.

Further provided is a peroxide liquid 54. The peroxide fills the upper chamber. A colorant liquid 56 is provided. The colorant liquid fills the lower chamber.

Provided last is a tool 60. The tool has a central extent 62. The central extent has a first end 64. The central extent also has a second end 66. The central extent has a cylindrical configuration. The central extent has a diameter. The diameter is between 30 percent and 50 percent of the diameter of the container. The central extent has a length. The length is between 60 percent and 80 percent of the length of the container. The tool has an angled point 68. The angled point is positioned at the first end. The angled point is adapted to puncture the membrane. In this manner the peroxide liquid and the colorant liquid are allowed to intermix forming a coloring composition. The tool has a brush 70. In this manner the user applies the coloring composition to the hair.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A hair coloring system (10) for storing hair coloring components, for intermixing the hair coloring components, and for applying the intermixed hair coloring components to hair, the storing and intermixing and applying being done in a safe, convenient, and economical manner, the system comprising, in combination:

a container (12) having a side wall (14) in a cylindrical configuration with a circular top (16) and a parallel circular bottom (18), the container including a membrane (20) in a circular configuration, the membrane located between and parallel with the top and the bottom, the membrane dividing the container into an upper chamber (22) and a lower chamber (24), the upper chamber located between the membrane and the top, the lower chamber located between the membrane and the bottom, the membrane located midway between the top and the bottom rendering the upper chamber and the lower chamber of a common volume, the membrane being fabricated of a fracturable material chosen from the class consisting of aluminum foil and tin foil, the container having a diameter and a length, the length being between 4 and 6 times the diameter;

a junction (28) formed in the container at an intermediate location dividing the container into of an upper region (30) with the upper chamber and a lower region (32) with the lower chamber, the upper region having a length and a radial interior annular recess (34) at the junction, the lower region having a length and a radial exterior annular recess (36) at the junction, the radial interior annular recess and the radial exterior annular recess being press fit together with the membrane there between;

a cover (40) having a circular configuration, the cover being fabricated of a flexible plastic material, an adhesive coupling the cover to the top of the container, a semi-circular tab (42) extending upwardly from the cover for removing the cover from the container prior to use;

a lid (46) having interior female threads (48), co-operable exterior male threads (50) on the container adjacent to the top, the exterior male threads of the container removably receiving and supporting the interior female threads of the lid, the container and the lid being fabricated of a rigid plastic material;

a peroxide liquid (54) filling the upper chamber between the membrane and the cover, a colorant liquid (56) filling the lower chamber between the membrane and the bottom;

a tool (60) having a central extent (62) with a first end (64) and a second end (66), the central extent having a cylindrical configuration with a diameter between 30 percent and 50 percent of the diameter of the container, the central extent having a length of between 60 percent and 80 percent of the length of the container, the tool having an angled point (68) at the first end adapted to puncture the membrane to allow the peroxide liquid and the colorant liquid to intermix and form a coloring composition in the container, the tool having a brush (70) for applying the coloring composition to hair of a user, the tool between the brush and the angled point being a right circular cylinder with a length greater than the length of the upper region.

* * * * *